US011299849B2

(12) United States Patent
Gartmann et al.

(10) Patent No.: US 11,299,849 B2
(45) Date of Patent: Apr. 12, 2022

(54) TEXTILES HAVING A PROTECTIVE FUNCTION AGAINST ABRASION AND CONTACT HEAT

(71) Applicant: Schoeller Textil AG, Sevelen (CH)

(72) Inventors: Vedran Gartmann, St. Gallen (CH); Roland Lottenbach, Staat (CH); Hans-Jürgen Hübner, Brione s.M. (CH)

(73) Assignee: SCHOELLER TEXTIL AG, Sevelen (CH)

( * ) Notice: Subject to any disclaimer, the term of this patent is extended or adjusted under 35 U.S.C. 154(b) by 170 days.

(21) Appl. No.: 14/351,539

(22) PCT Filed: Sep. 24, 2012

(86) PCT No.: PCT/EP2012/068773
§ 371 (c)(1),
(2) Date: Apr. 11, 2014

(87) PCT Pub. No.: WO2013/053587
PCT Pub. Date: Apr. 18, 2013

(65) Prior Publication Data

US 2014/0255664 A1 Sep. 11, 2014

(30) Foreign Application Priority Data

Oct. 13, 2011 (CH) ..... 01672/11

(51) Int. Cl.
*D06N 7/00* (2006.01)
*D06N 3/00* (2006.01)
(Continued)

(52) U.S. Cl.
CPC ..... *D06N 7/0092* (2013.01); *D06M 15/19* (2013.01); *D06M 23/16* (2013.01); *D06N 3/0063* (2013.01);
(Continued)

(58) Field of Classification Search
None
See application file for complete search history.

(56) References Cited

U.S. PATENT DOCUMENTS 4,680,076 A * 7/1987 Bard ..... C08G 59/40 156/306.9
6,080,215 A * 6/2000 Stubbs ..... B24D 11/04 51/293
(Continued)

FOREIGN PATENT DOCUMENTS

EP 2 063 017 A1 5/2009
WO WO 01/12889 2/2001
(Continued)

OTHER PUBLICATIONS https://en.wikipedia.org/wiki/titanium, visited on Jul. 21, 2016.*
(Continued)

*Primary Examiner* — Shawn Mckinnon
(74) *Attorney, Agent, or Firm* — Knobbe, Martens, Olson & Bear, LLP

(57) ABSTRACT

The invention relates to a textile sheet product. According to the invention, said textile sheet product is characterized by a plurality of coating elements, which are arranged on a surface of a textile substrate layer of the sheet product in such a way that only part of the surface of the substrate layer is covered by the coating elements. The coating elements are made of a material that substantially is a mixture of a polymer material, preferably a prepolymer that can be crosslinked to form a thermoset, and a filler in the form of inorganic and/or metal particles. In a method according to the invention for producing a textile sheet product, a textile substrate layer and a coating material are provided. In order to form coating elements, a plurality of portions of the coating material are applied to a surface of the substrate layer. The portions of the coating material are arranged on
(Continued)

the surface in such a way that the portions do not overlap, and only part of the surface of the substrate layer is covered by the coating material. Subsequently, the coating material is fixed, whereby a plurality of solid coating elements is formed on the substrate layer.

7 Claims, 2 Drawing Sheets

(51) Int. Cl.
*D06M 23/16* (2006.01)
*D06M 15/19* (2006.01)

(52) U.S. Cl.
CPC ... *D06N 2203/06* (2013.01); *D06N 2209/065* (2013.01); *D06N 2209/103* (2013.01); *D06N 2209/105* (2013.01); *D06N 2209/123* (2013.01); *D06N 2209/1642* (2013.01); *D06N 2211/10* (2013.01); *D06N 2211/103* (2013.01); *Y10T 428/2481* (2015.01)

(56) References Cited

U.S. PATENT DOCUMENTS 7,384,436 B2 * 6/2008 Sung ..... C09K 3/1463 264/122
2004/0192133 A1 * 9/2004 Kim ..... B32B 3/08 442/148
2007/0054578 A1 * 3/2007 Hoersch ..... D06M 13/52 442/148
2008/0041498 A1 * 2/2008 Inbe ..... C23C 22/80 148/254
2008/0269358 A1 * 10/2008 Inoue ..... B82Y 30/00 516/34

FOREIGN PATENT DOCUMENTS

WO WO0112889 * 2/2001
WO WO 02/10667 2/2002
WO WO 2004/055262 7/2004
WO WO 2011/103466 8/2011
WO WO2011103466 * 8/2011
WO WO 2012/164223 12/2012

OTHER PUBLICATIONS https://en.wikipedia.org/wiki/Contact_angle, visited on Jul. 22, 2016.*
https://en.wikipedia.org/wiki/Contact_angle (Year: 2020).*
English translation of International Search Report dated Jan. 17, 2013, International Application No. PCT/EP2012/068773.
English translation of Preliminary Report on Patentability dated Apr. 15, 2014, dated Apr. 15, 2014, International Application No. PCT/EP2012/068773.
English translation of the Written Opinion of the International Searching Authority, dated Apr. 13, 2014, International Application No. PCT/EP2012/068773.
Matting Agents, High Performance Minerals for Coatings, brochure, Imerys Pigments Inc. (2012).

* cited by examiner (a)

(b)

TEXTILES HAVING A PROTECTIVE FUNCTION AGAINST ABRASION AND CONTACT HEAT

This application is the U.S. National Phase under 35 U.S.C. § 371 of International Application No. PCT/EP2012/068773, filed Sep. 24, 2012, which claims priority to Swiss Application No. 01672/11, filed Oct. 13, 2011.

BACKGROUND

Field

The invention relates to textile sheet products which are abrasion resistant and/or offer protection against contact heat and/or are cut resistant, and a method for producing such textile sheet products.

Description of the Related Art

For various applications, highly abrasion-resistant materials are preferably used, in order to avoid excess wear and tear under normal use. Examples of such applications include functional articles of clothing for use in the field of sports and recreation, and work clothing and protective clothing. A high degree of abrasion resistance is also required in clothing for motorcyclists to prevent or reduce injuries in the event of an accident. Traditionally, leather is used for motorcyclist clothing. There are also plastic-based materials which have a high degree of abrasion resistance. However, a common feature of all of these materials is that they have only low or even no breathability due to their solid structure. Such materials also are usually stiff.

Materials are also known which protect against contact heat, for example, for use in work gloves, particularly for use in the kitchen area. However, a certain thickness of the material is required for this purpose, which in turn results in a certain stiffness of the material. When such gloves are worn for long periods of time, moisture also develops as a result of perspiration, which is uncomfortable.

Materials that have high breathability, optionally combined with high water repellency, are the current standard for use in high-quality functional clothing, for example, rain jackets. One example of such a functional fabric is known, for example, from WO 2002/075038. Likewise known are membrane-based systems. However, functional textiles of this type are not highly abrasion resistant, nor do they offer protection against contact heat.

SUMMARY

An object of the invention is to provide textile sheet products that do not have the above-mentioned or other disadvantages. In particular, such textile sheet products according to the invention should be both highly abrasion resistant and highly flexible.

Another object of the invention is to provide textile sheet products which are flexible and offer protection against contact heat.

A further object of the invention is to provide textile sheet products that are both cut resistant and flexible.

Advantageously, such textile sheet products according to the invention should offer high breathability.

It is also an object of the invention to provide a method for producing such textile sheet products according to the invention.

These and other objects are attained by a textile sheet product according to the invention, and by a method according to the invention for producing textile sheet products according to the independent claims. Additional preferred embodiments are specified in the dependent claims.

BRIEF DESCRIPTION OF THE DRAWINGS

To provide a better understanding of the present invention, reference will be made in the following to the set of drawings. The drawings show examples of embodiments of the subject matter of the invention.

DETAILED DESCRIPTION

Figure 1:
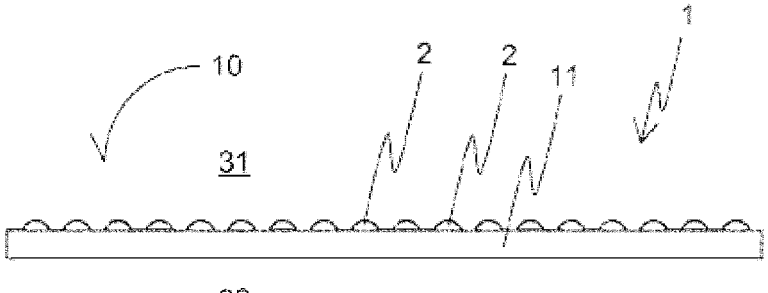
FIG. 1 shows a schematic illustration of an embodiment of a textile sheet product according to the invention, (a) in cross-section and (b) from a perspective view.
Figure 1:
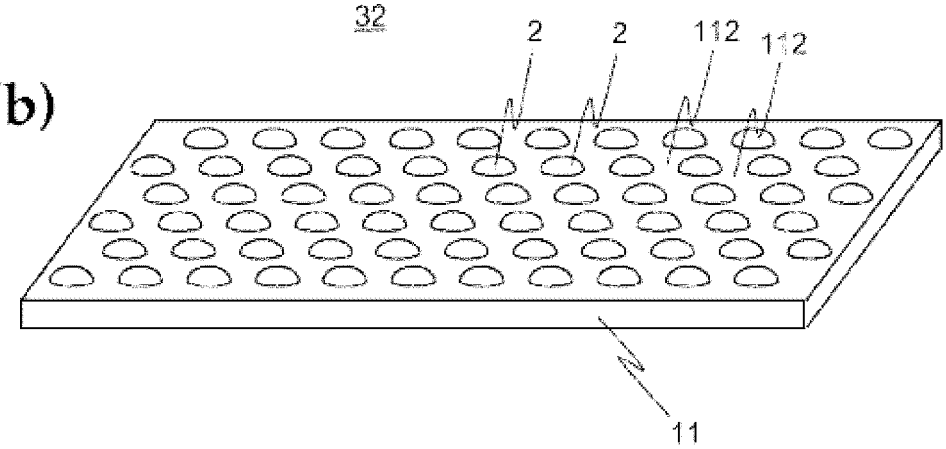

An inventive principle of a textile sheet product according to the invention is based on the concept of applying a plurality of coating elements to a substrate layer, which elements nevertheless do not substantially impact the pliability and flexibility of the substrate layer or of any other layers that may optionally be provided. The coating elements are embodied as abrasion resistant, and are arranged in such a way that when the textile sheet product is exposed to sliding friction against a rough surface, only the coating elements come into contact with the rough surface. The textile substrate layer itself is thus protected against abrasion.

Potential fields of application for such abrasion-resistant textile sheets include athletic clothing, work clothing and protective clothing, for example, for motorcyclists and firefighters. Sheet products according to the invention are highly suitable, in particular, for use in athletic clothing, since they can be designed to be breathable. For instance, it is possible, to produce lightweight, breathable clothing for bicyclists, which will nevertheless not fray on the asphalt if the cyclist should fall in an accident, and which are thus capable of protecting the wearer against skin injuries. Also advantageous is the use thereof for protecting highly delicate textiles, or for protecting exposed areas on articles of clothing that are subject to constant friction, for example, in outdoor jackets, the area against which a backpack would rub.

With a suitable, less heat-conducting embodiment of the coating elements, a textile sheet product according to the invention will also offer protection against contact heat, since only the coating elements can come into direct contact with a hot surface. One possible field of application is for work gloves, for example.

With one particularly advantageous embodiment of the shape and arrangement of the coating elements, it is also possible to obtain textile sheet products according to the invention that are cut resistant. This is achieved particularly when there is no straight line that does not intersect a single coating element on the substrate layer. A sharp edge, for example, the blade of a knife, will slide along the abrasion-resistant coating elements. Since it cannot come into contact with the substrate layer beneath said elements, the blade cannot cut through the textile sheet product.

A textile sheet product according to the invention is characterized by a plurality of coating elements, which are arranged on a surface of a textile substrate layer of the sheet product in such a way that only part of said surface of the substrate layer is covered by the coating elements. The coating elements consist of a material that is essentially a mixture of a polymer material, preferably a prepolymer that can be crosslinked to form a thermoset, and a filler material in the form of inorganic and/or metal particles.

The coating elements are advantageously distributed over the substrate layer in such a way that, in terms of pliability, the textile sheet product with coating elements corresponds substantially with the textile sheet product without coating elements.

The coating elements can be punctiform or circular, for example. One advantageous arrangement of coating elements comprises circular coating elements arranged offset from one another, for example, having a diameter of approximately 4 mm and a distance from adjacent coating elements of approximately 2 mm.

Advantageously, the proportion of coating elements on the surface of the substrate layer as a whole is between 30% and 70%, in order to guarantee flexibility while at the same time ensuring abrasion resistance.

In one advantageous embodiment of a textile sheet product according to the invention, the coating elements are formed and/or are arranged on the substrate layer in such a way that there is no continuous straight line on the surface of the substrate layer that does not intersect at least one coating element. As a result, the textile sheet product is cut resistant, since a sharp edge cannot reach the sensitive substrate layer.

The filler material particles of the coating material are advantageously selected from a group consisting of glass, quartz, feldspar, aluminum oxide (corundum), hard metal, hard ceramic, rock flour, and mixtures thereof. Particularly advantageous are spherical filler material particles, such as glass beads, ceramic beads or chilled cast iron beads, for example. The filler material particles should advantageously have a hardness of at least 5 on the Mohs scale.

The percentage of filler material in the coating material is preferably between 5 and 40% by volume. With a higher percentage, the adhesion and stability of the coating element will decrease. With a lower percentage, the abrasion resistance of the coating element will decrease.

In a sheet product according to the invention, the coating elements are preferably made of a coating material which comprises a hardenable prepolymer. Particularly suitable are epoxy resins, preferably liquid epoxy resins having a molar mass of <700 g/mol.

The coating material can comprise a rheological additive which is suitable for giving the as yet unhardened coating material thixotropic properties. Hydrophobic silicic acid is particularly suitable, for example.

In one advantageous embodiment of a sheet product according to the invention, said product is breathable. To achieve this, the sheet product can comprise a breathable membrane. However, other breathable textiles may also be used for sheet products according to the invention. Since only part of the surface is covered with coating elements, sufficient surface area remains for gas exchange.

The surface of the substrate layer and the coating elements can be provided with an additional coating.

In a method according to the invention for producing a textile sheet product, a textile substrate layer and a coating material are provided. The coating material comprises a polymer material and a filler material, which contains inorganic and/or metal particles. To form coating elements, a plurality of portions of the coating material are applied to a surface of the substrate layer, wherein the portions of the coating material are arranged on the surface in such a way that the portions do not overlap and only part of the surface of the substrate layer is covered by the coating material. The coating material is then fixed, thereby forming a plurality of solid coating elements on the substrate layer.

The substrate layer is advantageously embodied such that a viscous coating material is able to flow at least partially into the fibrous structure of the substrate layer.

In one advantageous embodiment of the method according to the invention, after the coating material has been applied to the surface of the substrate layer but before it is fixed, the coating material penetrates partially into the fiber structure of the textile substrate layer, so that, after fixing, a positive connection between the substrate layer and the coating material is produced.

The surface of the substrate layer is preferably configured, for example by means of coating, such that the contact angle in air between surface and coating material is greater than 60°, preferably greater than 80°. As a result, the portions of the viscous coating material will not run on the surface of the substrate layer. As a further effect, the penetration depth of the polymer into the coating material decreases, so that the polymer preferably will not penetrate through the entire thickness of the substrate layer.

The polymer material of the coating material is advantageously a prepolymer that can be crosslinked to form a thermoset, in particular, a hardenable epoxy resin prepolymer. Such a prepolymer can be cold-hardening, heat-hardening or UV-hardening.

The plurality of portions of the coating material can be applied to the surface of the substrate layer by means of screen printing.

FIG. 1 shows a basic example of a textile sheet product 1 according to the invention. A plurality of coating elements 2 are arranged on a substrate layer 11. In the present example, the substrate layer 11 is a single textile layer of the sheet product 1. It can be embodied as a woven fabric, a knitted fabric or a non-woven fabric. In any case, however, it is advantageous for the coating material that will be applied in a viscous, unhardened state to be able to flow to at least a shallow depth into the structure of the substrate layer 11, in order to achieve an positive connection between the coating elements 2 and the substrate layer after hardening. The method by which the coating elements are applied will be specified in greater detail further below.

In the illustrated embodiment of a sheet product according to the invention, the coating elements 2 are embodied as circular raised areas arranged in the form of a grid. However, other embodiments and arrangements are also possible.

Figure 2:
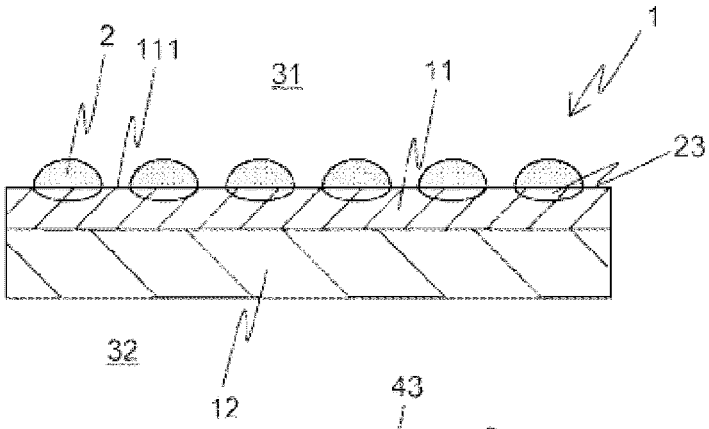
FIG. 2 shows a schematic cross-section of an embodiment of a flexible sheet product according to the invention with two layers.

In another advantageous embodiment of a textile sheet product 1 according to the invention, the first substrate layer 11 is embodied as relatively thin, and is arranged on a second layer 12, which can be thicker. Such a variant is illustrated schematically, for example, in FIG. 2.

The first layer 11 can be embodied, for example, as a thin but stable, tear-resistant fabric. The hardened coating elements 2 are arranged on a surface 111 of this substrate layer, and are joined in a positive connection with the fabric 11. This side of the substrate layer therefore forms the outer surface/right side 10 of the textile sheet product, which is protected against abrasion and/or contact heat.

The second layer can be embodied, for example, as a knitted fabric or as a foamed polymer, which has a certain thickness and therefore acts as a cushioning layer. The two layers can be bonded to one another, for example, by gluing or by lamination. The layers can be bonded to one another before or after the coating elements are applied.

Figure 3:
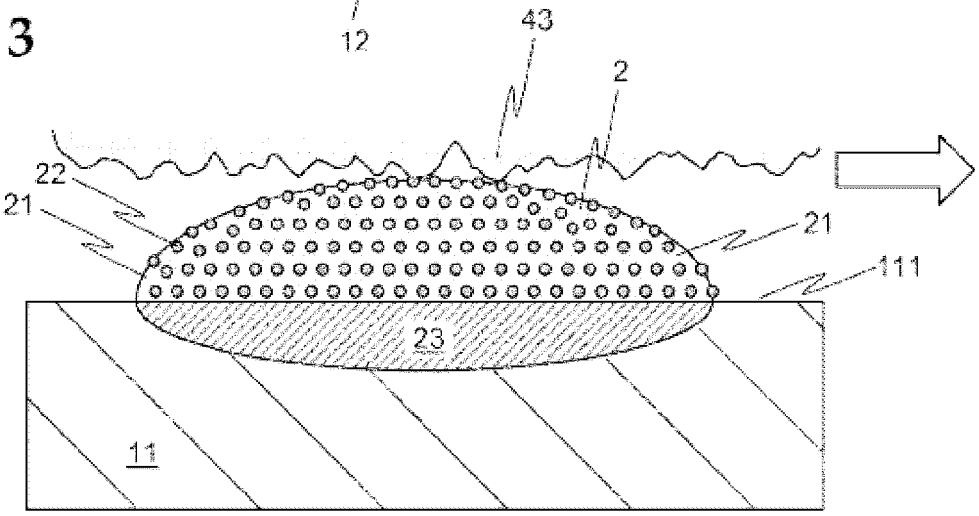
FIG. 3 shows a schematic cross-section illustrating the detail of a single coating element arranged on the first substrate layer, which is in sliding friction with a rough surface.

The mode of functioning of a textile sheet product according to the invention is illustrated by way of example in FIG. 3, as a schematic cross-section of a substrate layer 11 with a single coating element 2. This element is in the form of a raised area, which projects beyond the surface 111 of the substrate layer.

As the still viscous, unfixed coating material is being applied to the substrate layer, part of the polymer material penetrates into the upper layer of the textile structure of the substrate layer. In this region 23, the polymer material flows around the fiber structure of the substrate layer, and once it is hardened, forms an extremely stable positive connection. Depending upon the type of filler material and the substrate layer that are used, some of the filler material particles can optionally also penetrate into the substrate structure. Once the coating material has been hardened, the particles 22 of the filler material are fixed in a positive manner within the polymer matrix 21 of the coating element.

When the outer side of the textile sheet product according to the invention comes into contact with a rough, two-dimensional surface 43, which is illustrated in FIG. 3 as an irregular edge sliding across the surface of the coating element in the direction of the arrow, due to the arrangement of the plurality of coating elements 2 on the substrate layer 11, essentially only the coating elements 2 can come into contact with this rough surface. In contrast, the substrate layer is spatially separated from the surface 43, and as a result, the substrate layer is protected against abrasion.

On the outer surface of the coating elements 2, a certain proportion of the hard, advantageously spherical particles 22 is partially exposed. As a result, the rough surface 43 comes into contact primarily with the rounded, hard surface of the particles. Since these particles are harder than the rough surface, no or only low abrasion of the particles themselves occurs. Only those parts of the crosslinked polymer matrix that are uncovered, if any, will be removed by abrasion, however, this will automatically partially uncover additional hard particles near the surface. The result is an overall structure which has a very high abrasion resistance.

In order to find an optimal maximum abrasion resistance, a compromise must be reached with respect to the volume ratio of polymer matrix to filler material particles. A higher proportion of polymer means increased stability of the polymer matrix 21, and therefore an increased fixation of the particles in the polymer matrix. A higher proportion of filler material will increase the quantity of abrasion-resistant particles on the surface, so that less polymer matrix is uncovered. Optimal values are naturally dependent in each case upon the type of polymer and the nature of the filler material.

To obtain a breathable sheet product according to the invention, a breathable membrane can be arranged at a suitable location, for example. One such possible embodiment is illustrated schematically in FIG. 4(*a*). A breathable membrane 13 is arranged between the substrate layer 11 and the second layer 12.

Figure 4:
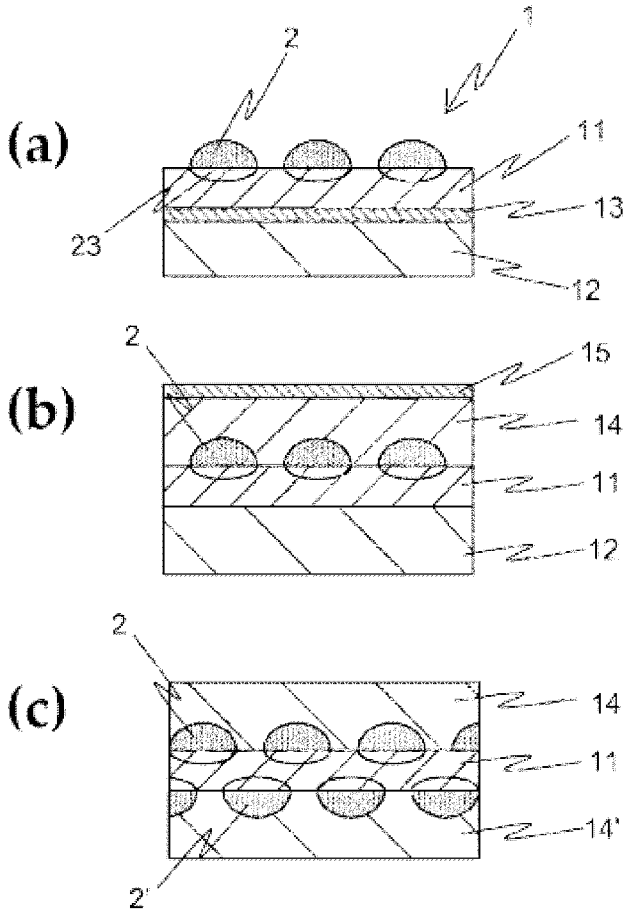
FIGS. 4*a-c* show schematic cross-sections of additional embodiments of sheet products according to the invention.

A further embodiment of a textile sheet product according to the invention is illustrated in FIG. 4(*b*), in which an additional coating 14 is applied to the outer side, and completely covers the substrate layer 11 and the coating elements 2 applied thereto. Such a coating can consist, for example, of a foamed, flexible polymer layer 14, for example, a polyurethane polymer, which is applied to the substrate layer 11 once the coating elements 2 have been applied and hardened. In the example shown, the outer side is also provided with an additional textile layer 15.

An embodiment of this type is advantageous, for example, when it is not desirable for the coating elements to be visible under normal conditions. One possible field of application is that of textiles for motorcyclists, for example. Under normal conditions, only the outer layer 15 is visible. In an accident, the outer layers 15, 14 will wear away very rapidly as a result of abrasion. However, the coating elements 2 beneath said outer layers will prevent further penetration. The wearer remains protected.

Another variant of a textile sheet product according to the invention is illustrated in FIG. 4(*c*). In this embodiment, coating elements 2, 2' are applied to both sides of the substrate layer 11. A coating 14,

14' is likewise applied to both sides of the substrate layer 11 and the coating elements. This type of textile sheet product according to the invention offers the advantage that the two sides can be used equally for the same purpose.

Due to the high abrasion resistance of the coating elements, textile sheet products according to the invention are highly suitable for the production of cut resistant textiles. A sharp edge, for example, a blade, cannot penetrate through the coating elements of a textile sheet product according to the invention. If these coating elements are then applied in a suitable form and in a suitable arrangement to the substrate layer, so that no geometric situation exists in which a straight edge 42 does not intersect at least one coating element 2, a cut resistant textile sheet product will result.

Figure 5:
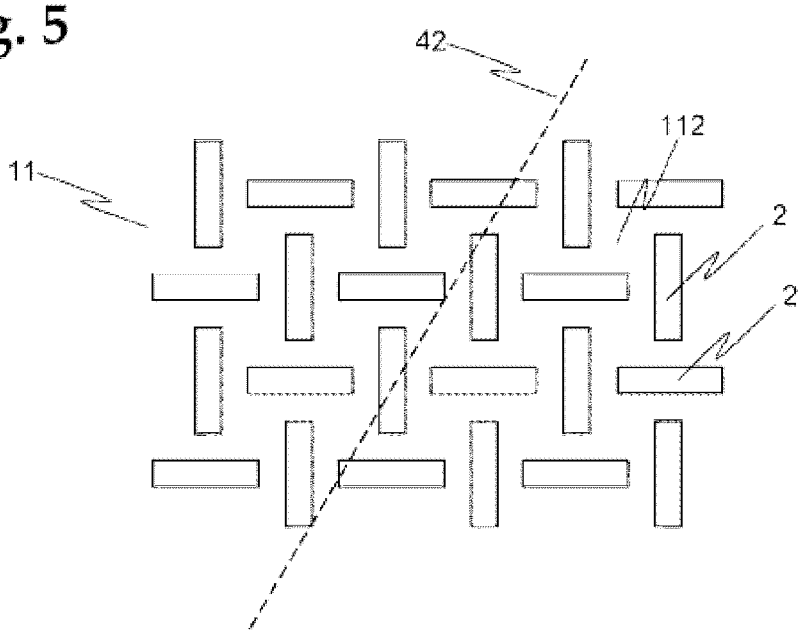
FIG. 5 shows an advantageous arrangement of coating elements on a sheet product according to the invention in which no continuous intersecting edge exists.

On possible example of such an arrangement of coating elements 2 is shown in FIG. 5. A plurality of rectangular coating elements 2 is arranged alternatingly horizontally and vertically. The result is a pattern in which there is no straight edge 42 that does not intersect with a coating element 2. As a result, any sharp edge will merely slide across the surface of the coating elements, and will not come into contact with the substrate layer 11 in the interstices 112. The substrate layer and/or any layers of the sheet product that lie beneath said layer cannot be cut through.

The pattern shown in FIG. 5 is merely one of a plurality of possible cut resistant patterns. These can be optimized based upon the desired property. In principle, a larger number of coating elements will result in greater cut resistance, but also in increased stiffness of the textile sheet product.

Coating Material

The coating material for coating the substrate layer of the textile sheet according to the invention with the coating elements comprises substantially a polymer material and a filler material in the form of the hard particles, which ensure the abrasion resistance of the coating elements. Added to this are further constituents for influencing the properties of the coating material.

The main components of the coating material are the polymer material and the filler material. The fixed, preferably thermosetting polymer must be capable of holding the embedded filler materials with sufficient strength to allow said materials to withstand the strong forces to which they are exposed during use. In contrast, the particles of the filler materials must have the highest possible pressure resistance and hardness, so that they will be damaged as little as possible during use.

Thermosets have the particular advantage that they will not melt. Even when exposed to heavy friction, the coating elements will remain stable because they will not melt under frictional heat.

As a polymer for the coating material, liquid-resin prepolymers are advantageously used, e.g. epoxy resins having a molar mass of <700 g/mol. These can be embodied as cold-hardening, heat-hardening or UV-hardening. When liquid resins are used, less pitting occurs for physical reasons, and the formation of Bénard cells is made impossible. To prevent the formation of pores in the interior of the material, which would have a negative effect on the mechanical stability of the fixing elements, the coating material should be as free from air as possible.

The liquid-resin prepolymer is advantageously 100%, i.e. without solvents. This prevents the formation of pores as a result of evaporating solvent and a slow drying phase before the start of the crosslinking reaction.

Suitable filler materials include materials that have hard inorganic/mineral or metal particles. Particularly advantageous are hard, spherical particles, such as are used, for example for shot blasting, especially since the requirements placed on these materials are similar. Suitable materials include glass beads, ceramic beads and chilled cast iron beads, for example.

One advantage of spherical particles is the low abrasion of the particles that lie on the surface of the coating elements, since the spherical surface thereof has low interaction with other surfaces when exposed to sliding friction, resulting in a lower absorption of force from an object rubbing across the coating elements on the particles. A further advantage of spherical filler material particles over broken, angular filler material particles is the property that spherical particles in dispersion have less influence on viscosity.

The optimal filler material content is dependent on the type of filler material itself and the type of polymer material, and on the adjustment of the properties of the coating elements. For example, good results are achieved with a 70% by weight (wt/%) proportion of filler material in the total mixture. At lower fill material concentrations, abrasion resistance decreases, since more of the polymer matrix is uncovered on the surface of the coating elements. At higher filler material concentrations, the stability of the polymer matrix in which the particles are embedded decreases, which likewise leads to a decrease in abrasion resistance. In addition, the adhesion of the coating elements to the substrate layer of the textile sheet product according to the invention also decreases.

For coating the substrate layer with the coating elements, a paste-like coating material is advantageous. In the case of a paste approach, the resin prepolymer is preferred. If necessary, additives for obtaining better producibility of the coating material, such as crosslinking agent and dispersant, for example, are then added. Optional additives such as dyes, additives for improving long-term stability (light protection agents, free radical scavengers, etc.) and additives for additional functions are then added, with agitation. The filler materials are then dispersed in the paste. Rheological additives are not added until the end, so that the other constituents can be mixed in more easily.

The rheological additives serve to adjust the viscosity of the coating material to a value that is suitable for the invention. As a rheological additive, highly thixotropic types are advantageously chosen, in order to keep the flow resistance in the delivery lines low, while at the same time achieving a high stability of the coating elements applied to the substrate layer. An undesirable running of the coating elements that have not yet hardened following application is thereby avoided. Additionally, due to the high viscosity of the resting thixotropic paste, a mixture produced in this manner will have a lower tendency toward sedimentation.

The addition of hardening agents is implemented differently, depending upon type. Cold-hardening types of hardening agents are added shortly prior to production, while monitoring pot life. Heat-hardening types of hardening agents may be added to the resin as the first component. With UV-hardening mixtures, the UV-initiator can likewise be the first component added to the resin; however, the paste should be strictly protected from light.

Suitable parameters for a paste-like coating material include, for example, a viscosity of 80 to 200 dPas, a filler material proportion of 30 to 70 wt/%, and a particle size of the filler material of between 15 and 1000 μm, preferably <150 μm. Suitable liquid resins include bisphenol-A resins and aliphatic epoxy resins.

Whether the coating material is embodied as cold-hardening, heat-hardening or UV-hardening is not directly relevant to the invention, and must instead be directed to the concrete embodiment of the coating method.

The composition of the coating material should be selected such that the shortest possible hardening time is required, and the lowest possible exothermy occurs. Hardening times should lie within the range for normal finishing methods for textiles. An unduly high exothermy during hardening would lead to a highly localized increase in the temperature, which might damage the substrate layer.

The hardened coating elements should also preferably have high resistance to solvents, fuels, acids and alkaline solutions.

EXAMPLES OF FORMULATIONS FOR THE COATING MATERIAL

In what follows, a number of examples of formulations for producing coating material masses for sheet products according to the invention and/or methods according to the invention are specified.

Example 1

Cold-Hardening

| Proportion (parts by weight | Constituent | Examples |
|---|---|---|
| 1000 parts | Synthetic resin | Bisphenol A and/or F/epichlorohydrin resin (aromatic types), hexahydrophthalic acid resin (cycloaliphatic types) |
| As needed | Additives to improve producibility | Crosslinking agents, deaerators, defoaming agents, etc. |
| As needed | Additives to improve functionality | Scratch resistance: e.g. using paraffins; UV-absorbers; e.g. benzatriazole derivatives; free radical scavengers; e.g. HALS compounds |
| As needed | Additives for additional functions | e.g. flame retardants such as expandable graphite; luminescent additives |
| 15 parts | Dye | e.g. carbon black, powdered pigments |
| 600 parts | Hard particles (filler material) | e.g. glass beads, ceramic beads, chilled cast iron beads |

-continued

| Proportion (parts by weight | Constituent | Examples |
|---|---|---|
| 60 parts | Rheological additives | e.g. hydrophobic silicic acid |
| 270 parts | Hardeners* | e.g. cycloaliphatic amines |

*The hardeners must be admixed prior to application, taking pot time into consideration.

Example 2

Heat-Hardening

| Proportion (parts by weight | Constituent | Examples |
|---|---|---|
| 1000 parts | Synthetic resin | Bisphenol A and/or F/epichlorohydrin resin (aromatic types), hexahydrophthalic acid resin (cycloaliphatic types) |
| As needed | Additives to improve producibility | Crosslinking agents, deaerators, defoaming agents, etc. |
| As needed | Additives to improve functionality | Scratch resistance: e.g. using paraffins; UV-absorbers; e.g. benzatriazole derivatives; free radical scavengers; e.g. HALS compounds |
| As needed | Additives for additional functions | e.g. flame retardants such as expandable graphite; luminescent additives |
| 15 parts | Dye | e.g. carbon black, powdered pigments |
| 600 parts | Hard particles (filler material) | e.g. glass beads, ceramic beads, chilled cast iron beads |
| 30 parts | Rheological additives | e.g. hydrophobic silicic acid |
| 110 parts | Hardeners | Temperature-activated crosslinking agents, e.g. dicyandiamide derivatives |

Example 3

Heat-Hardening

| Proportion (wt/%) | Constituent |
|---|---|
| 1000 | (Bis-A) aromatic epoxy resin: "Epikote resin 828LVEL" (Hexion Specialty Chemicals) |
| 120 | Temperature activated crosslinking agents: triglycidyl isocyanurate (TGIC) |
| 30 | Rheological additive: hydrophobic silicic acid "Aerosil R202" (Evonik Industries) |
| 270 | Hard particles (filler material): red noble corundum P220 |
| 16 | Dye: gas black "Spezialschwarz 4" (Degussa) |

Example 4

Heat-Hardening

| Proportion (wt/%) | Constituent |
|---|---|
| 1000 | Cycloaliphatic epoxy resin: "Epikote resin 760" (Hexion Specialty Chemicals) |
| 120 | Temperature activated crosslinking agents: dicyandiamide |
| 30 | Rheological additive: hydrophobic silicic acid "Aerosil R202" (Evonik Industries) |
| 290 | Hard particles (filler material): red noble corundum P220 |
| 16 | Dye: gas black "Spezialschwarz 4" (Degussa) |

Example 5

UV-Hardening

| Proportion (parts by weight) | Constituent | Examples |
|---|---|---|
| 1000 parts | Synthetic resin | Bisphenol A and/or F/epichlorohydrin resin (aromatic types), hexahydrophthalic acid resin (cycloaliphatic types) |
| As needed | Additives to improve producibility | Crosslinking agents, deaerators, defoaming agents, etc. |
| As needed | Additives to improve functionality | Scratch resistance: e.g. using paraffins; UV-absorbers; e.g. benzatriazole derivatives; free radical scavengers; e.g. HALS compounds |
| As needed | Additives for additional functions | e.g. flame retardants such as expandable graphite; luminescent additives |
| 15 parts | Dye | e.g. carbon black, powdered pigments |
| 600 parts | Hard particles (filler material) | e.g. glass beads, ceramic beads, chilled cast iron beads |
| 30 parts | Rheological additives | e.g. hydrophobic silicic acid |
| 10 parts | UV initiators | Light-activated crosslinking agents, e.g. triarylsulfonium salts |

Application of the Coating Elements

The textile sheet to be coated is advantageously at least temporarily hydrophobed, in order to prevent the paste from sinking in too far. This can be achieved, for example, by means of impregnation or by a single-sided coating, for example, with a fluorocarbon finishing compound.

To apply the coating elements to the substrate layer, a screen printing method is advantageously used, for example, by means of rotary screens or flat screens. The panel thickness of the screens is advantageously between 0.5 and 4 mm. The imprinted surface should be between 30 and 70% of the total surface of the substrate layer. The higher the degree of coverage, the more the feel of the textile is impacted.

The screens rest on the substrate layer to be coated, and the paste is applied to the screen and then doctored using a doctor blade. The paste is removed from the screen surface and remains in the openings. When the screen is removed, the coating elements remain adhered to the substrate layer. Taking the screen geometry and the nature of the substrate material into account, the paste viscosity and paste density of the coating material, the doctor blade pressure, and the distance from the substrate must be adapted to one another.

The volume of coating material to be applied varies depending upon the property to be achieved in the textile sheet product according to the invention, and amounts to approximately 100 to 1500 g/m$^2$, preferably 100 to 600 g/m$^2$. The paste penetrates to a shallow depth into the surface of the textile prior to hardening, wherein after hardening, the positive connection between the crosslinked polymer matrix and the structure of the substrate layer results in a very solid, mechanical anchoring of the coating elements on the substrate layer, and therefore high adhesion.

In a first step, the coating elements are hardened, in other words, the crosslinking reaction of the thermoset/prepolymer mixture is started. No drying is necessary, since the paste preferably contains no solvents. The hardening conditions are then adapted to the resin systems that are used. If temperature-activated crosslinking agents are used, or if a self-crosslinking binder system is used, a certain reaction temperature must be reached following application of the coating elements. The typical parameters are as follows: cold-hardening mixtures: 120-200° C.; heat-hardening mixtures: 150-200° C.

When UV-crosslinking agents are used, the substrate layer with the coating elements is irradiated with UV radiation, in order to initiate the crosslinking reaction. No increase in temperature is required for hardening; however, a thermal post-hardening at 150 to 200° C. is possible.

Under the above-stated conditions, the coating elements must be hardened at least enough that they will no longer stick, and will be sufficiently stable, and that they will not smear or smudge and cannot be otherwise destroyed. The substrate layer can then be rolled or stacked, or be fed directly to the finished textile sheet product for further processing, in which, for example, additional layers are applied.

The coating material can then be post-crosslinked, if necessary, by means of a repeated temperature treatment. However, the resins used also react to some extent at room temperature, up to the point of full hardening.

The disclosed specific embodiments are not suitable for limiting the scope of the present invention. The preceding description and the drawings also suggest to a person skilled in the art various potential alterations and modifications in addition to the disclosed examples, which are likewise covered by the scope of protection of the claims.

LIST OF REFERENCE SIGNS

1 textile sheet product
10 outer surface of the sheet product
11 first layer, substrate layer
12 second layer
13 breathable membrane
14, 14' coating
15 layer
111 surface
112 interstice
2, 2' coating element
21 polymer matrix
22 filler material particles
23 region of the positive connection
31 outer side
32 inner side
42 straight intersecting edge
43 rough surface

The invention claimed is:

1. A method for producing a textile sheet product, the method comprising:
- providing a textile substrate layer;
- at least temporarily hydrophobing a first side of the textile substrate layer;
- providing a coating material on the first side of the textile substrate layer, comprising a polymer material and a filler material, which contains inorganic and/or metal particles;
- forming coating elements by,
  - applying a plurality of portions of the coating material to the surface of the substrate layer,
  - arranging the portions of the coating material on the surface of the substrate layer such that the portions do not overlap, and only a portion of the surface of the substrate layer is covered by the coating material; and
  - fixing the coating material, whereby a plurality of solid coating elements is formed on the substrate layer, wherein the proportion of coating elements on the entire surface of the substrate layer is between 30% and 70%, wherein the volume of the coating material on the textile substrate layer is 100 to 1500 g/m2,
  - wherein the surface of the substrate layer is embodied, by coating, such that the contact angle in air between surface and coating material is greater than 60°.

2. The method of claim 1, wherein the substrate layer is embodied such that a viscous coating material is able to flow at least partially into a fiber structure of the substrate layer.

3. The method of claim 1, wherein, after applying a plurality of portions of the coating material to the surface of the substrate layer, and prior to fixing the coating material, the coating material penetrates partially into a fiber structure of the textile substrate layer, so that, after fixation, a positive connection is produced between the substrate layer and the coating material.

4. The method of claim 1, wherein the contact angle is greater than 80°.

5. The method of claim 1, wherein the polymer material of the coating material is a prepolymer that can be crosslinked to form a thermoset, wherein the prepolymer is a hardenable epoxy resin prepolymer.

6. The method of claim 1, wherein the plurality of portions of the coating material are applied to the surface of the substrate layer by means of screen printing.

7. The method of claim 1, wherein the at least temporarily hydrophobing a first side of the textile substrate layer is achieved by impregnation.

* * * * *